US005573157A

United States Patent [19]

Mauriello et al.

[11] Patent Number: 5,573,157

[45] Date of Patent: Nov. 12, 1996

[54] SECURITY MEANS FOR A PISTOL HOLSTER

[76] Inventors: Gerald Mauriello, 29 Landcaster Rd., Colonia, N.J. 07067; Patrick Carrow, 735 Park Ave., East Orange, N.J. 07017

[21] Appl. No.: 258,838

[22] Filed: Jun. 13, 1994

[51] Int. Cl.[6] ..... F41C 33/02

[52] U.S. Cl. ..... 224/244; 224/911

[58] Field of Search ..... 224/243, 244, 224/911, 912

[56] References Cited

U.S. PATENT DOCUMENTS

| | | | |
|---|---|---|---|
| 468,556 | 2/1892 | Anderson | 224/244 X |
| 1,750,139 | 3/1930 | Swift | 224/911 |
| 4,318,503 | 3/1982 | Capano | 224/911 |
| 5,275,317 | 1/1994 | Rogers et al. | 224/244 |
| 5,284,281 | 2/1994 | Nichols | 224/244 |

*Primary Examiner*—Renee S. Luebke

*Attorney, Agent, or Firm*—M. K. Silverman

[57] ABSTRACT

A security system for use in a pistol holster for the selectable engagement and disengagement of the trigger guard of a pistol or gun. The system, more particularly, includes a segment of a resilient material having a free first end and a second end rigidly affixed to a lower internal co-planar holster surface facing away from the torso of the user, the first end defining a substantial U-shaped portion within a plane substantially transverse to the internal surface of the holster, the U-shaped portion proportioned, in geometry and resilience, to engage the trigger guard responsive to an application of downward pressure upon the first end of the segment by the trigger guard. The security system further includes an element for selectable urging the U-shaped portion of the segment off of the trigger guard responsive to pressure applied onto the top of a release element slidably secured within the holster surface. This is located at an upper part of the holster between the inner surface and the body of the user, and an opposite end of the release element in cam-like engagement with the U-shaped portion.

2 Claims, 2 Drawing Sheets

18
22
20
23
32
34
28
26
33
24
30
35
36
38
40
42
44
46

SECURITY MEANS FOR A PISTOL HOLSTER

BACKGROUND OF THE INVENTION

The present invention relates to gun safety holster and, more particularly, to holsters provided with means to prevent an unexpected or undesired removal of the gun from the holster.

Notwithstanding the existence of many proposals in the prior art of gun holsters featuring safety means to prevent an attacker from drawing the pistol from the holster of a law officer, each year many officers are shot by their own pistols because assailants were able to remove the pistols from the officers' holsters. Apparently, these casualties occur because many of the prior art security means for preventing unauthorized removal of guns from holsters were so impractical that they were either not adopted or, in actual use, failed to provide the intended protection to the wearer thereof.

The art in the instant area is represented by such patents as U.S. Pat. No. 1,851,352 to Denkert; U.S. Pat. No. 4,076,156 to Katz; and U.S. Pat. No. 4,318,503 to Capano. Such prior art has proved inadequate for a variety of reasons, these including unduly complex mechanisms, mechanisms that are difficult to utilize, those that are unreliable and those that are cost-prohibitive.

The instant invention therefore responds to the above needs for an economical, easy to-use and reliable safety holster particularly adapted for use by law enforcement personnel.

SUMMARY OF THE INVENTION

The invention constitutes a security means for use in a pistol holster for the selectable engagement and disengagement of the trigger guard of a pistol or gun. The means, more particularly, includes a planar segment of a resilient material having an end defining a substantially U-shaped portion within a plane substantially transverse to said internal surface of said holster, said U-shaped portion proportioned, in geometry and resilience, to engage said trigger guard responsive to an application of downward pressure upon the trigger guard. The inventive security means further includes means for selectably urging the U-shaped portion of the planar segment off of the trigger guard responsive to pressure applied to release means slidably secured within said holster surface. The release means is located at an upper part of said holster between the inner surface thereof and the body of the users, and the opposite end of the release means in cam-like engagement with said U-shaped portion.

It is accordingly a principal object of the present invention to provide a pistol holster including safety means to prevent the unexpected and undesired removal of the pistol from said holster.

It is another object of the invention to provide a safety means to affirmatively engage and scare the trigger guard of the gun or pistol until the removal thereof by the user is desired.

It is another object to provide a security means of the above type which is substantially inconspicuous to a non-user thereof.

It is a further object to provide a security means of the above type in which the release means for the trigger guard is substantially inaccessible to a potential assailant.

It is a yet further object to provide a security means of the above type which is convenient to use, reliable, of light weight, and cost-effect to manufacture.

The above and yet other objects and advantages of the present invention will become apparent from the hereinafter set forth Brief Description of the Drawing, Detailed Description of the Invention and claims appended herewith,

BRIEF DESCRIPTION OF THE DRAWINGS

FIGS. 4A thru 4F comprise a sequence of views all in plane at ninety degrees to the plane of FIG. 3, in which FIGS. 4A thru 4C show the manner of engagement of a trigger guard by the U-shaped portion of the resilient segment, and in which FIGS. 4D thru 4F show the manner of release of the trigger guard of a piston through the use of the release member of the system.

DETAILED DESCRIPTION OF THE INVENTION

Figure 1:
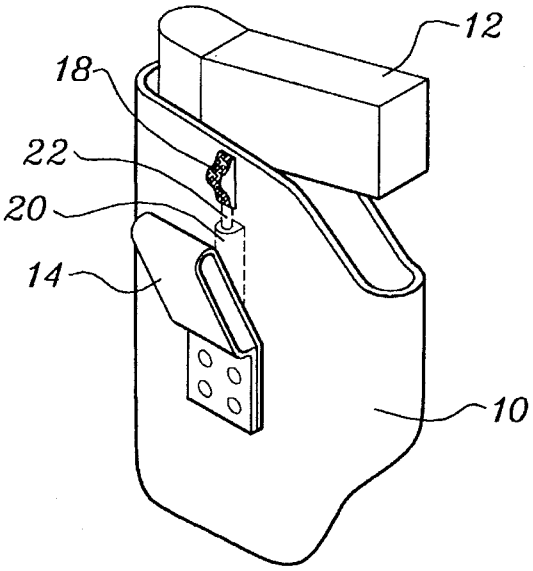
FIG. 1 is a perspective view of-the inventive security system showing a pistol positioned therein.

With reference to FIG. 1 there is shown, in perspective view, a piston holster 10 for the containment of a pistol or gun 12. As may be appreciated, holster 10 appears, externally, much like any other pistol holster, including the provision of a loop 14 which is adapted for placement about belt 16 (see FIG. 2) of the user of the system.

Figure 3:
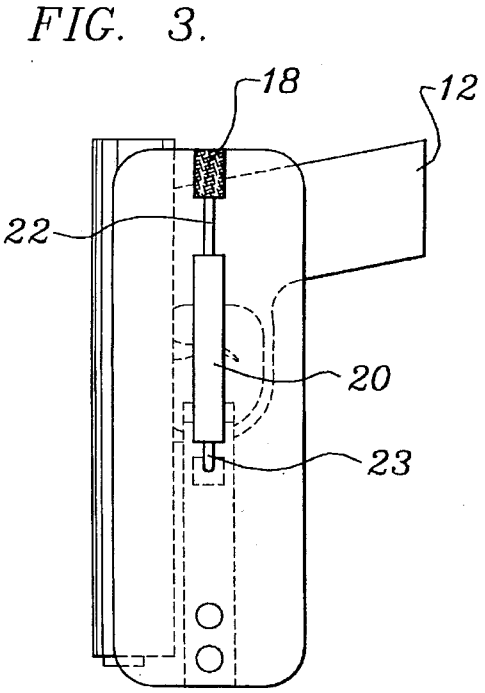
FIG. 3 is a vertical cross-sectional view of the inventive system taken in a plane parallel to a plane of the pistol between the inner pistol surface and the trigger guard release member.
Figure 2:
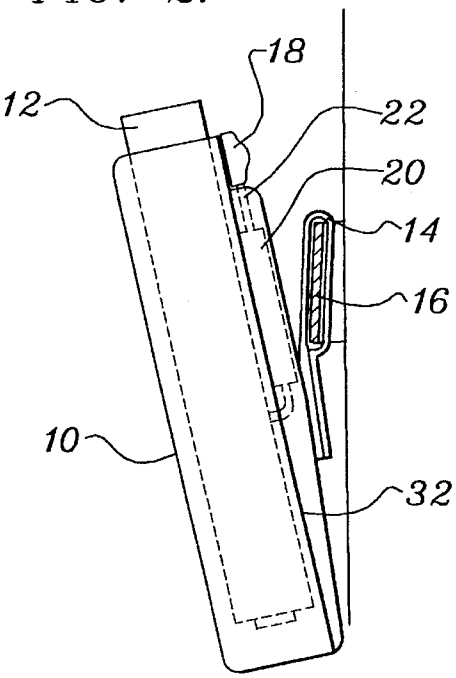
FIG. 2 is a front view of the system of FIG. 1 shown the same attached to the belt of a user.

As may be noted in FIGS. 1 thru 3, there is provided a top 18 of trigger guard release means 22 (more fully described below) which, upon depression thereof, enables gun 12 to be removed from holster 10. As may be seen in the side view of FIG. 3, piston release means 22 includes a hollow rigid cylindrical element 20 affixed to the holster surface 32 thru element 20 which has a L-shaped rigid member 23. A lower horizontal portion 24 of said L-shaped element 23 is shown in FIGS. 4A thru 4F.

With further reference to the sequential views of FIG. 4, the present security means may be seen to include a segment 26 of a resilient material having a free end 28 and a non-free end 30 rigidly affixed to said lower holster surface 32 of said holster that is parallel with the principal plane of said segment 26.

As may be noted in the views of FIG. 4, said resilient segment 26 is attached to said surface 32 as to face outwardly from the body of the user of the security holster. In other words, the elements to the left of surface 32 in FIG. 4 face toward to the user's body while elements to the right of surface 32 face away therefrom.

Figures 4A, 4B, 4C, 4D, 4E, 4F:
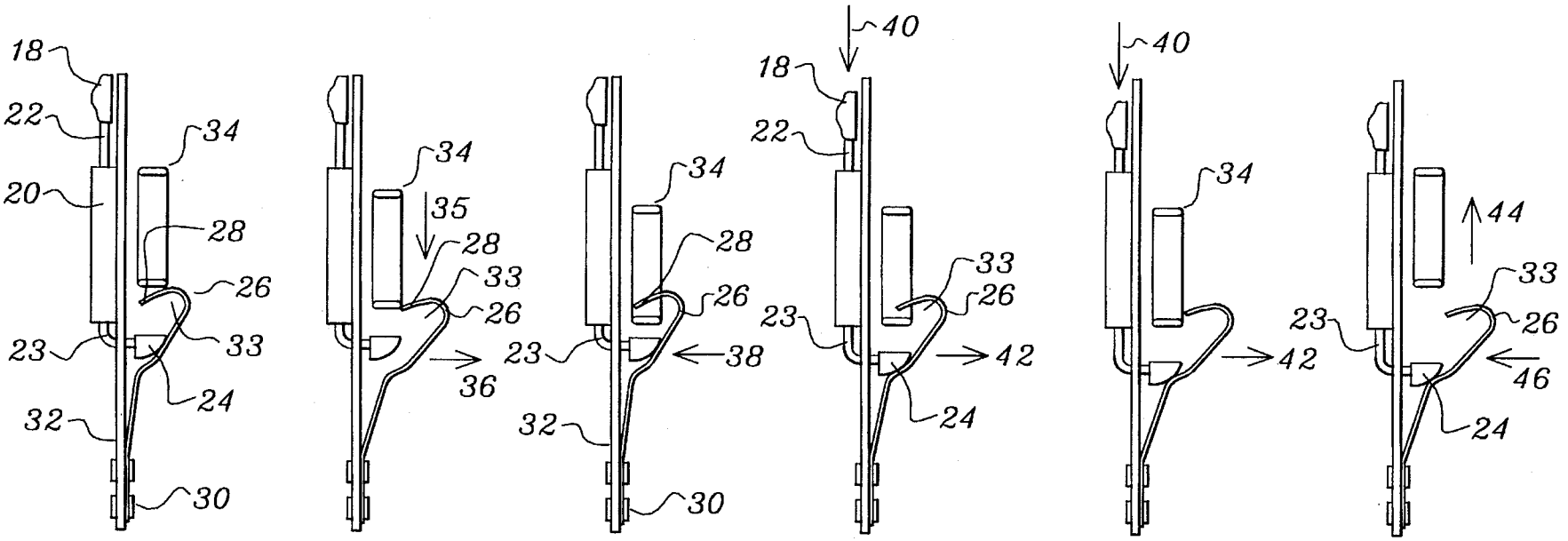

Said first end 28 of segment 26 may, further, be seen to include a substantially U-shaped portion 33 within a plane that is substantially transverse to said internal surface 32. The significance of such a U-shaped geometry may be seen with reference to the views of FIGS. 4A thru 4C. Therein, as may be noted, as the trigger guard 34 is depressed (see arrow 35 in FIG. 4B) end 28 of segment 26 will be urged to the right as is shown by arrow 36. At the time corresponding to the view of FIG. 4*b*, trigger guard 34 will slip past end 28 of the segment 26 which will cause segment 26 to snap in direction 38 as is shown in FIG. 4C. Thereupon, the trigger guard 34 will be effectively locked between end 28 of segment 26 and the inner open area of the U-shaped portion 33 of segment 26. Therefore, in the condition shown in FIG. 4C, unauthorized removal of pistol 12 is effectively impossible because of the engagement of the trigger guard of the pistol by the upper part of the segment.

To effect the removal of the trigger guard and, therefore, the gun from the segment 26 pressure 40 (see FIG. 4D) is applied onto top 18 of release means 22 which force is transmitted through rigid member 23 into the horizontal direction noted by arrow 42 in FIGS. 4D and 4E. The resultant motion of segment 26 will enable pistol 12, and its associated trigger guard 34, to be lifted off of segment 34 in direction 44 as is shown in FIG. 4F. Upon release of pressure 40 upon release means 22, segment 26 will return (see arrow 46) to its normal position shown in FIG. 4A. It is, accordingly, to be appreciated that segment 26 is spring biased in the direction of surface 32 and, thereby, upon release of pressure 49 return to the position of surface 32 and thereby, returns to the position of FIG. 4A in the absence of the application of pressure thereto, either by trigger guard 34 or by end 24 of the release means 22. Therefore, segment 26 may be displaced to the right either by the application of force 35 to first end 28 as is shown in FIG. 4B or by the application of force 42 at the lower portion thereof by end 24 of release means 22 as shown in FIGS. 4D and 4E.

As may be seen end 24 of means 22 may comprise a cam-like element to minimize the necessary range of travel of rigid member 23.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what we claim as new, useful and non-obvious and, accordingly, secure by Letters Patent is:

1. In a pistol holster, an improved security system for a trigger guard of a pistol, the system comprising:

(a) a segment of a resilient material having a first end that is free and a second end rigidly affixed to a lower internal co-planar holster surface of said holster facing away from a torso of a user thereof, said first end defining a substantially U-shaped portion within a plane substantially transverse to said internal surface of said holster, said U-shaped portion proportioned, in geometry and resilience, to engage said trigger guard responsive to an application of downward pressure upon said first end of said segment by said trigger guard; and (b) an L-shaped rigid member, slidably secured between said holster and said torso, having a button-like element at a top of a vertical portion of a lower horizontal portion engageable with said U-shaped portion of said segment upon depression of said top of said vertical portion of said L-shaped rigid member, whereby a depression of said top of said L-shaped rigid member urges said segment off of said trigger guard.

2. The system as recited as claim 1, in which a free end of said L-shaped member engagable with said U-shaped portion includes cam means.

* * * * *